United States Patent [19]

Lover

[11] Patent Number: 5,007,556

[45] Date of Patent: Apr. 16, 1991

[54] METERING DISPENSER

[75] Inventor: Myron J. Lover, Mountainside, N.J.

[73] Assignee: Block Drug Company, Inc., Jersey City, N.J.

[21] Appl. No.: 510,681

[22] Filed: Apr. 18, 1990

[51] Int. Cl.[5] ..... B65D 83/14

[52] U.S. Cl. ..... 222/386.5; 222/1; 222/387; 222/389; 222/402.2

[58] Field of Search ..... 222/1, 386.5, 387, 389, 222/402.2

[56] References Cited

U.S. PATENT DOCUMENTS

| | | | |
|---|---|---|---|
| 3,089,624 | 5/1963 | Micallef | 222/386.5 |
| 3,104,785 | 9/1963 | Beard, Jr. | 222/402.2 X |
| 3,132,570 | 5/1964 | Hoffman, Jr. et al. | 222/389 X |
| 3,161,330 | 12/1964 | Sagarin et al. | 222/402.2 X |
| 3,169,670 | 2/1965 | Hrebenak et al. | 222/387 X |
| 3,245,582 | 4/1966 | Roth et al. | 222/386.5 X |
| 3,273,762 | 9/1966 | O'Neill, Jr. | 222/389 |
| 3,275,200 | 9/1966 | Livingstone | 222/389 |
| 3,362,589 | 1/1968 | Kinnavy et al. | 222/389 |
| 3,464,596 | 9/1969 | Meshberg | 222/402.2 |
| 4,034,899 | 7/1977 | Meshberg | 222/402.2 X |
| 4,346,743 | 8/1982 | Miller | 222/386.5 X |
| 4,679,706 | 7/1987 | Magid et al. | 222/402.18 X |
| 4,870,805 | 10/1989 | Morane | 222/386.5 X |
| 4,909,420 | 3/1990 | Reyner | 222/386.5 |
| 4,919,312 | 4/1990 | Beard et al. | 222/402.2 |

*Primary Examiner*—Kevin P. Shaver

*Attorney, Agent, or Firm*—Ostrolenk, Faber, Gerb & Soffen

[57] ABSTRACT

A system accurately dispenses fluid by filling a metering chamber with fluid from a container. A barrier is used to pressurize the fluid so that substantially no vapor or gas remains within the metering chamber and so that substantially no vapor or gas exists within the containe. A metered dose is dispensed from the metering chamber through a valved outlet.

10 Claims, 5 Drawing Sheets

METERING DISPENSER

BACKGROUND OF THE INVENTION

Dispensers with metering valves have been developed for dispensing volumetrically controlled doses of fluid such as aerosol sprays, foams, creams, gels, and the like.

FIG. 1 illustrates such a valve 10 for use with a container (not illustrated) of pressurized fluid to be dispensed. Preferably, the fluid is pressurized by a gaseous propellant. The propellant is dissolved within the fluid to be dispensed, or liquefied and mixed with the fluid to be dispensed, especially when it is desired to dispense a foam.

The metering valve 10 includes a rigid metering chamber 12 with a valve stem 14 extending therethrough. A lower opening 16 of the metering chamber 12 is connected to an inlet tube 18. The inlet tube 18 extends almost to the bottom of the container for conducting fluid to be dispensed from the container into the metering chamber 12.

A valved inlet passageway 20 is located in the vicinity of the opening 16 and a valved outlet passageway 22 is located at the top of the metering chamber 12. The valved inlet passageway 20 and the valved outlet passageway 22 are selectively opened and closed depending on the position of the valve stem 14. A coiled compression spring 24 biases the valve stem 14 upwardly toward the position illustrated in FIG. 1.

In the position illustrated in FIG. 1, the valved inlet passageway 20 is open and pressurized fluid to be dispensed is forced upwardly through the inlet tube 18 and the passageway 20, and fills the metering chamber 12 until the pressure of the fluid in the metering chamber 12 is equal to the pressure of the fluid in the container. When the valve stem 14 is pushed downwardly, the passageway 20 is closed and the outlet passageway 22 is simultaneously opened. This exposes the fluid in the metering chamber 12 to ambient pressure. As a result, the propellant dissolved or mixed within the fluid expands and the fluid is dispensed outwardly through the passageway 22.

When released, the valve stem 14 is returned by the spring 24 to the position illustrated in FIG. 1, closing the outlet passageway 22 and opening the inlet passageway 20, permitting more fluid to fill the metering chamber 12. In this way, a metered dose corresponding (ideally) to the volume of the metering chamber 12 is dispensed each time the valve stem 14 is pushed downwardly.

The metering valve 10 described above in connection with FIG. 1 is disclosed in detail in U.S. Pat. No. 4,034,899, issued July 12, 1977. Other similar valves are also disclosed in this prior patent. The entire disclosure of U.S. Pat. No. 4,034,899 is incorporated herein by reference.

The amount of fluid dispensed by a dispenser with a metering valve such as the valve 10 is a function of the volume of the valve's metering chamber. Ideally, the amount dispensed would consistently correspond to the volume of the metering chamber so that the amount of each and every dispensed dose could be accurately predetermined. However, prior art metering dispensers have been inaccurate and imprecise. Particularly, such dispensers have been subject to random inter-dose variability.

The problem appears to be that when a dose is dispensed from a metering chamber (such as the metering chamber 12), pressure within the metering chamber is reduced to ambient or atmospheric pressure (or at least a pressure less than the pressure within the container). Then, when pressurized fluid from the container is introduced into the metering chamber, a randomly variable amount of flashing or vaporization (or evolution of propellant gas) occurs as the fluid to be dispensed encounters the relatively low pressure within the metering chamber. As a result, the metering chamber can never be filled entirely by liquid. The drop in pressure and the resulting gas and/or vapor within the metering chamber introduces uncertainty and imprecision into the dispensing process since the amount of gas and/or vapor evolved from the fluid tends to be erratic, or at least cannot be accurately predetermined.

Such inconsistency or imprecision has proven to be a particular problem with prior art dispensers having so-called large-dose metering valves. As used herein, the term "large-dose metering valve" means a metering valve whose metering chamber has a volume of not less than about 200 microliters. Random interdose variability is particularly noticeable when the volume of the metering chamber exceeds 500 microliters.

A "flexible" metering valve 40 is illustrated in FIG. 2. Features of the valve 40 which are similar to the valve 10 are identified by the same reference numerals in the drawings.

The metering valve 40 has an enlarged metering chamber indicated generally at 42. The enlarged metering chamber 42 is formed by supplementing the volume of the rigid chamber 12 of the metering valve 10 with an elastomeric wall 44. The rigid chamber 12 communicates with the space 46 defined within the wall 44 through openings 48.

In operation, when the metering valve 40 is in the position illustrated in FIG. 2, fluid flows upwardly through the inlet tube 18, through the open valved inlet passageway 20, and fills the enlarged metering chamber 42 (both the rigid chamber 12 and the space 46). When the valve stem 14 is pushed downwardly, the passageway 20 is closed and the passageway 22 is simultaneously opened. As in the valve 10, fluid within the enlarged metering chamber 42 then expands outwardly in the direction of atmospheric pressure through the passageway 22. Since the wall 44 is flexible, the pressurized fluid outside of the wall 44 collapses the wall 44 to assist in the dispensing of the fluid from the space 46.

When released, the valve stem 14 is moved upwardly by the spring 24, closing the passageway 22 and opening the inlet passageway 20. Fluid is then forced upwardly through the inlet tube 18 to fill the rigid chamber 12. The space 46 is also filled through the openings 48 because of the resilience of the wall 44 (even though the pressure within the space 46 is never greater than the pressure surrounding the wall 44).

It appears that the wall 44 may actually somewhat reduce the problems associated with vaporization or evolution of gas within the metering chamber 42. However, any benefits are offset by practical variances in the wall's 44 resilient return to the position illustrated in FIG. 2. That is, the wall 44 does not always return to exactly the same position.

The metering valve 40 described above in connection with FIG. 2 is disclosed in detail in U.S. Pat. No. 3,104,785, issued Sept. 24, 1963. Other similar valves are also disclosed in this prior patent. The entire disclosure of U.S. Pat. No. 3,104,785 is incorporated herein by reference.

SUMMARY OF THE INVENTION

It is an object of the invention to improve the precision or consistency of metering dispensers, particularly large-dose metering dispensers.

Another object of the invention is to provide foam of consistent density and stability from dose to dose as the contents of the dispenser are consumed.

These objects, and others, are achieved by a dispenser which includes a container for containing fluid to be dispensed and a metering valve connected to the container. The metering valve includes: a metering chamber; a valved inlet for introducing a metered dose of the fluid into the metering chamber when the valved inlet is open; and a valved outlet for dispensing the metered dose from the metering chamber when the valved inlet is closed. The dispenser further includes a barrier for pressurizing the fluid so that substantially no vapor or gas remains within the metering chamber when the valved inlet is open.

The invention is also directed to a method of dispensing fluid. The method includes the steps of: filling a metering chamber with fluid from a container to form a metered dose within the metering chamber; using a barrier to pressurize the fluid so that substantially no vapor or gas remains within the metering chamber and so that substantially no headspace of vapor or gas exists within the container; and dispensing the metered dose from the metering chamber through a valved outlet.

Other features and objects of the invention will become apparent from the following detailed description of the preferred embodiments of the invention considered in conjunction with the accompanying drawings.

DETAILED DESCRIPTION OF THE PREFERRED EMBODIMENTS

Figure 1:
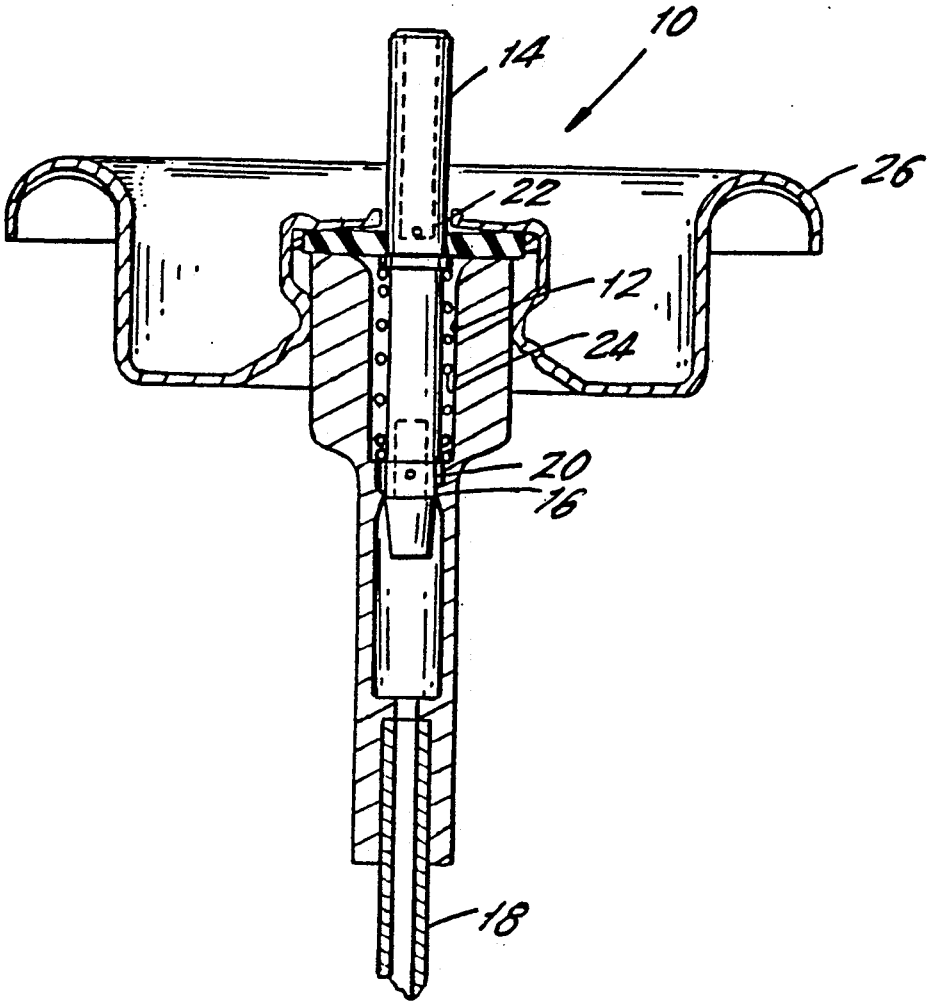
FIG. 1 PRIOR ART
FIG. 1 is a cross-sectional view of a metering valve.
Figure 2:
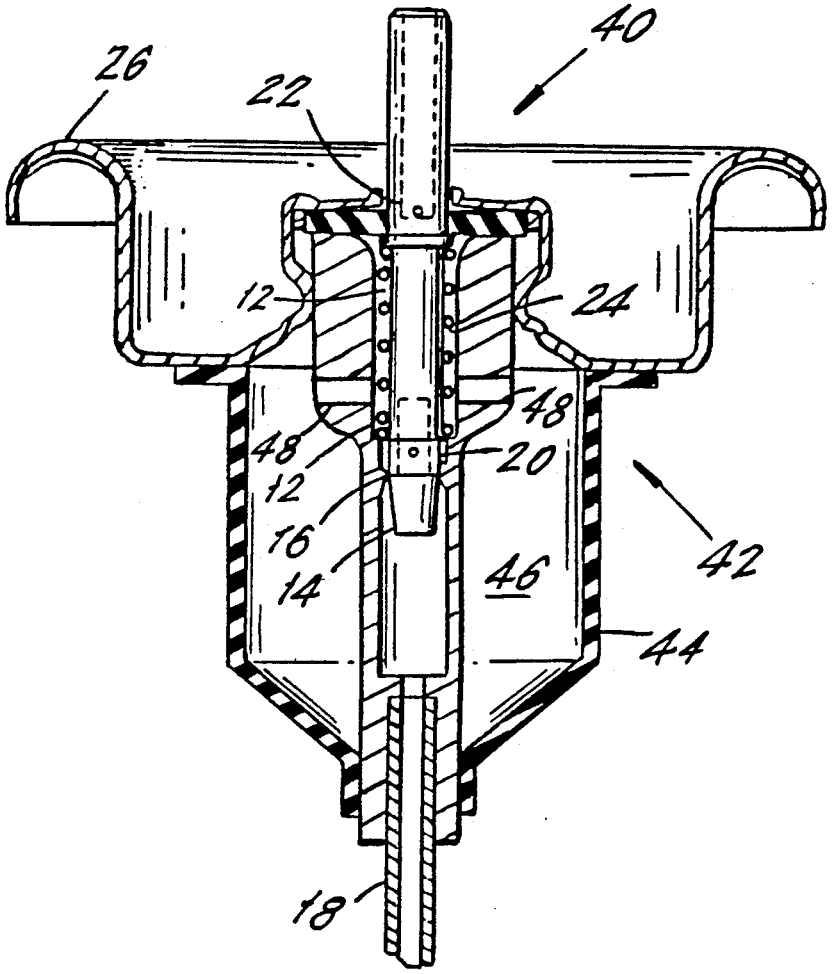
FIG. 2 PRIOR ART
FIG. 2 is a cross-sectional view of a flexible metering valve.
Figure 3:
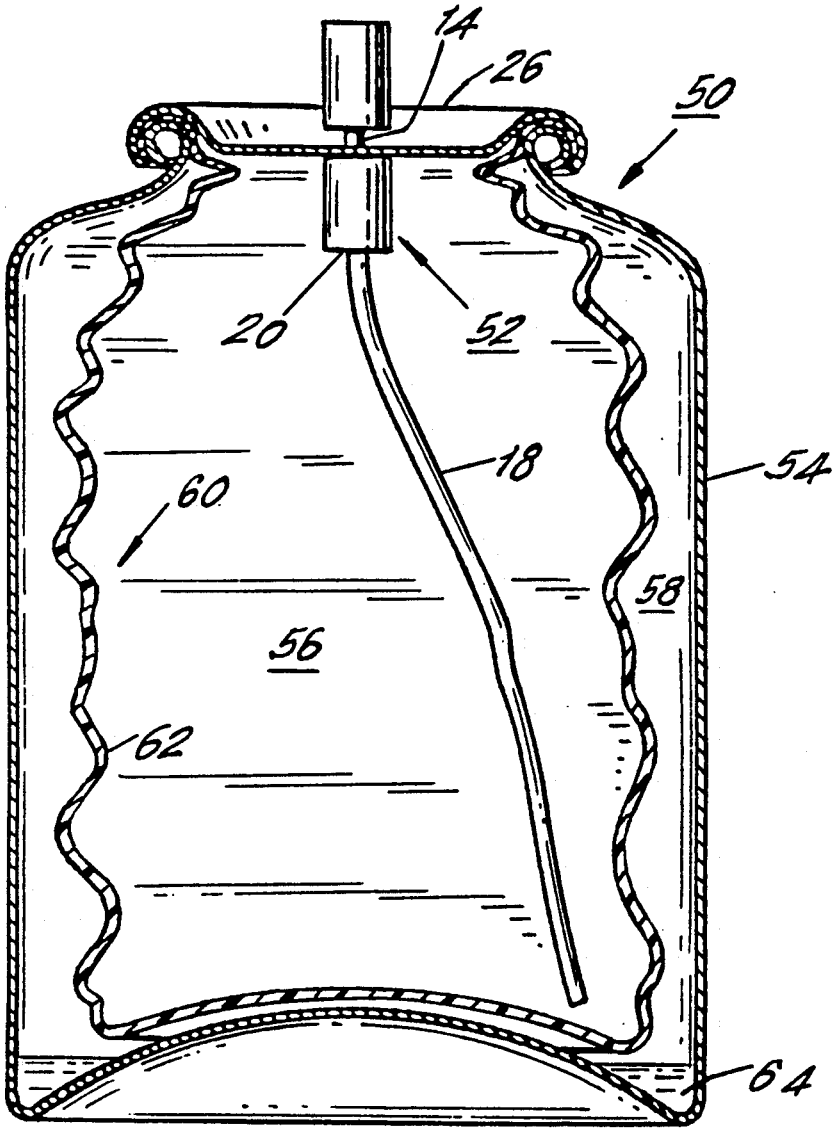
FIG. 3 is a cross-sectional view of a preferred embodiment of the invention.

Referring to FIG. 3, a dispenser 50 in accordance with a preferred embodiment of the invention includes a metering valve indicated generally at 52. The metering valve 52 can be the valve illustrated in FIG. 1, any one of the valves disclosed in U.S. Pat. No. 4,034,899, the entire disclosure of which is incorporated herein by reference, the flexible metering valve 40 illustrated in FIG. 2 of the present application, any one of the flexible metering valves disclosed in U.S. Pat. No. 3,104,785, the entire disclosure of which is incorporated herein by reference, or any one of the valves disclosed in U.S. Pat. No. 3,235,135, issued Feb. 15, 1966, the entire disclosure of which is incorporated herein by reference. The invention has particular advantages when the valve 52 is a large-dose metering valve, preferably one having a metering chamber with a volume of about 500 microliters or more.

The metering valve 52 is connected to a pressure-resistant container 54 by a conventional collar 26.

The container 54 is divided into two chambers 56 and 58 by a barrier 60. The barrier 60 is formed of a flexible gas-impermeable bag 62 connected to the container 54 in the vicinity of the collar 26. The first chamber 56 contains the fluid to be dispensed and should be filled without air entrainment and with virtually no headspace therewithin. The second chamber 58 contains pressurized gas and/or vaporizable fluid at a pressure which is greater than the vapor pressure of the fluid within the first chamber 56, and which is thereby sufficient to compress the fluid to be dispensed such that substantially no headspace of vapor or evolved propellant gas is created within the chamber 56 and such that no vapor or evolved gas remains within the metering chamber 12 or 42 (FIGS. 1–2) after a metered dose has been dispensed from the valve 52. The fluid within the chamber 58 includes liquid propellant 64 and gaseous propellant evaporated from the liquid propellant 64.

A flexible bag and pressurized fluid which can be adapted for use within the present invention is disclosed in U.S. Pat. No. 3,541,581, issued Nov. 17, 1970, the disclosure of which is incorporated herein by reference. Another exemplary bag is disclosed in U.S. Pat. No. 4,346,743, issued Aug. 31, 1982, the disclosure of which is incorporated herein by reference.

Figure 4:
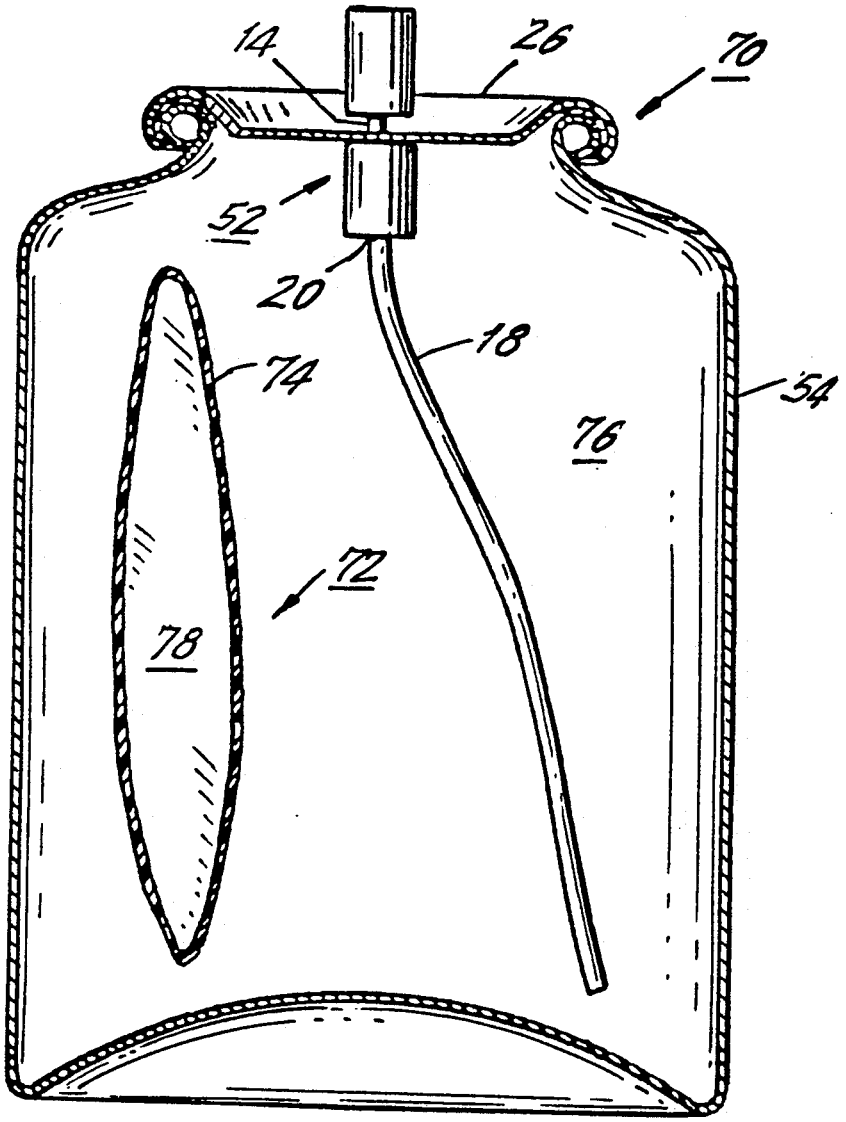
FIG. 4 is a cross-sectional view of another preferred embodiment of the invention.

FIG. 4 illustrates a dispenser 70 in accordance with another preferred embodiment of the invention. This embodiment includes a barrier 72 formed of an expandable bag 74. The bag 74 is enclosed entirely within the container 54. The bag 74 divides the container 54 into two chambers 76 and 78. The fluid to be dispensed is located within the chamber 76. The chamber 78 contains pressurized and expandable fluid for pressurizing the fluid in the chamber 76 such that there is substantially no headspace of vapor or evolved gas within the chamber 76 and such that substantially no vapor or evolved gas remains within the metering chamber of the metering valve 52 after fluid has been dispensed therefrom.

A system which can be adapted for use within the present invention is disclosed in U.S. Pat. No. 4,679,706, issued July 14, 1987, the disclosure of which is incorporated herein by reference.

Figure 5:
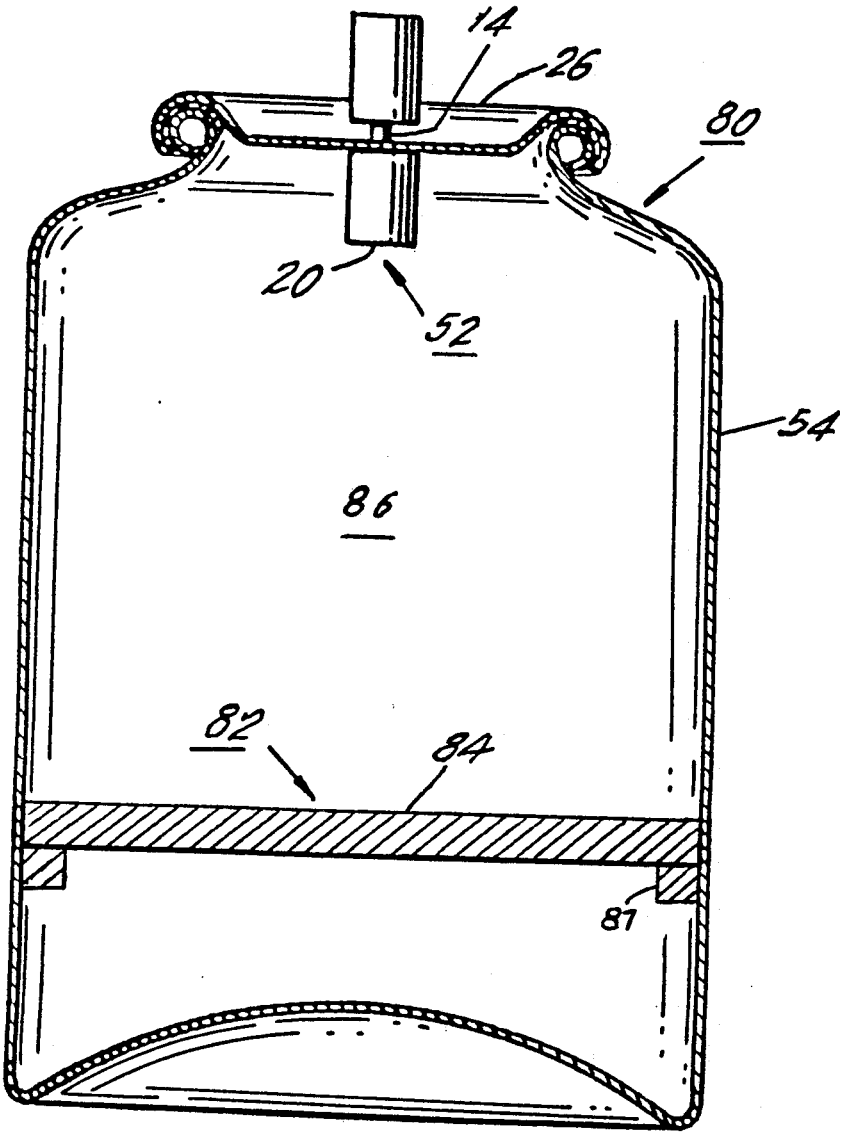
FIG. 5 is a cross-sectional view of still another preferred embodiment of the invention.

FIG. 5 illustrates a dispenser 80 in accordance with another preferred embodiment of the invention. The dispenser 80 includes a barrier 82 in the form of a slidable piston 84 for pressurizing a chamber 86 such that substantially no headspace exists within the chamber 86 and such that substantially no vapor or evolved gas remains within the metering chamber of the metering valve 52 after fluid has been dispensed therefrom. A stabilizing piston skirt 87 prevents the piston 84 from tipping.

The formation of headspace within the metering valve 52 can also be reduced by trying to achieve laminar flow through the inlet passageway 20. Avoiding sharp edges, points, or sudden changes in direction through the inlet passageway 20 will reduce the amount of gas formed within the metering chamber of the metering valve 52.

The invention can achieve inter-dose variability of less than ± 10%.

Although the invention has been described in connection with preferred embodiments thereof, many variations and modifications may become apparent to those skilled in the art. It is preferred, therefore, that the present invention be limited not by the specific disclosure herein, but only by the appended claims.

What is claimed is:

1. A dispenser, comprising:

(A) a container for containing fluid to be dispensed;

(B) a metering valve connected to said container, said metering valve comprising:

(a) a metering chamber;

(b) a valved inlet for introducing a metered dose of the fluid into said metering chamber when said valved inlet is open; and (c) a valved outlet for dispensing the metered dose from said metering chamber when said valved inlet is closed; and (C) a barrier for pressurizing the fluid so that substantially no vapor or gas remains within said metering chamber when said valved inlet is open.

2. The dispenser of claim 1, wherein said barrier is formed of a flexible gas-impermeable bag, said bag being connected to said container, said bag and said container defining a first chamber for containing the fluid to be dispensed and a second chamber for containing a second fluid or gas at a pressure sufficient to compress the fluid to be dispensed so that substantially no vapor or gas exists within said first chamber.

3. The dispenser of claim 1, wherein said barrier is formed of an expandable bag enclosed within said container, said expandable bag containing vaporizable fluid or gas for pressurizing the fluid to be dispensed.

4. The dispenser of claim 1, wherein said barrier is formed of a slidable piston for pressurizing the fluid to be dispensed.

5. The dispenser of claim 1, wherein said metering valve is a large-dose metering valve, and said metering chamber has a volume of not less than about 200 microliters.

6. The dispenser of claim 5, wherein said metering chamber has a volume of not less than about 500 microliters.

7. A dispenser, comprising:

(A) a container containing fluid to be dispensed;

(B) a metering valve connected to said container, said metering valve comprising:

(a) a metering chamber;

(b) a valve stem extending through said metering chamber;

(c) a first passageway for introducing a metered dose of said fluid into said metering chamber when said valve stem is in a first position;

(d) a second passageway for dispensing the metered dose from said metering chamber when said valve stem is in a second position;

(e) means for closing said first passageway when said valve stem is in said second position;

(f) means for closing said second passageway when said valve stem is in said first position; and (g) means for biasing said valve stem toward said first position; and (C) pressurizing means for pressurizing said fluid to be dispensed so that substantially no vapor or gas remains within said metering chamber when said valve stem is in said first position, said pressurizing means including pressurizing fluid and a barrier for separating said fluid to be dispensed from said pressurizing fluid, the pressure of said pressurizing fluid being greater than the vapor pressure of said fluid to be dispensed.

8. The dispenser of claim 7, wherein said metering valve is a large-dose metering valve.

9. The dispenser of claim 7, wherein said metering chamber includes a rigid wall, an elastomeric wall for supplementing the volume defined by said rigid wall, and an opening through said rigid wall for communicating with the volume defined by said elastomeric wall.

10. A method of dispensing fluid, said method comprising the steps of:

filling a metering chamber with fluid to be dispensed from a chamber of a container to form a metered dose within said metering chamber, said fluid to be dispensed having propellant dissolved or mixed therein;

pressurizing said fluid so that substantially no vapor or gas remains within said metering chamber and so that substantially no vapor or gas exists within said chamber of said container, said step of pressurizing said fluid including using pressurizing gas and a barrier for separating said fluid to be dispensed from said pressurizing gas, the pressure of said pressurizing gas being greater than the vapor pressure of said fluid to be dispensed; and dispensing said metered dose from said metering chamber through a valved outlet.

* * * * *